US005681655A

United States Patent [19]

Al Ghatta et al.

[11] Patent Number: 5,681,655

[45] Date of Patent: Oct. 28, 1997

[54] FILAMENTS WITH HIGH ELASTIC MODULUS FROM POLYESTER RESINS

[75] Inventors: Hussain Ali Kashif Al Ghatta, Fiuggi; Tonino Severini, Colleferro; Sandro Cobror, Naples, all of Italy

[73] Assignee: Sinco Engineering S.p.A., Italy

[21] Appl. No.: 537,879

[22] PCT Filed: Apr. 29, 1994

[86] PCT No.: PCT/EP94/01369

§ 371 Date: Jan. 2, 1996

§ 102(e) Date: Jan. 2, 1996

[87] PCT Pub. No.: WO94/26961

PCT Pub. Date: Nov. 24, 1994

[30] Foreign Application Priority Data

May 6, 1993 [IT] Italy ..... MI93A0900

[51] Int. Cl.[6] ..... D02G 3/00; C08G 63/02; C08J 5/15; C08F 20/00

[52] U.S. Cl. ..... 428/364; 428/395; 528/272; 528/308; 528/308.2; 524/109; 525/437; 525/444

[58] Field of Search ..... 525/437, 444; 428/364, 395, 36.5, 36.92, 373; 524/109; 528/272, 308, 308.2

[56] References Cited

U.S. PATENT DOCUMENTS

| | | | |
|---|---|---|---|
| 2,615,784 | 10/1952 | McClellan et al. . | |
| 3,520,770 | 7/1970 | Shima et al. | 428/370 |
| 4,176,101 | 11/1979 | Leslie et al. | 428/35 |
| 4,917,848 | 4/1990 | Kurita et al. . | |
| 5,382,628 | 1/1995 | Stewart et al. | 525/174 |
| 5,391,330 | 2/1995 | Jones et al. | 528/272 |
| 5,416,148 | 5/1995 | Farah et al. | 524/409 |
| 5,461,092 | 10/1995 | Laugher | 523/436 |

*Primary Examiner*—Newton Edwards

*Attorney, Agent, or Firm*—Edward D. Manzo; Mark J. Murphy; Ted K. Ringsred

[57] ABSTRACT

Filaments from a polyester resin having an elastic modulus higher than 30 GPa and stress at break greater than 300 MPa. The filaments are obtained by upgrading under stretch filaments prepared from polyester resin mixed in the melt with a polyfunctional compound able to increase the polymer intrinsic viscosity by addition reaction in the solid state with the terminal groups of the resin.

2 Claims, No Drawings

FILAMENTS WITH HIGH ELASTIC MODULUS FROM POLYESTER RESINS

BACKGROUND OF THE INVENTION

The present invention concerns polyester fibres with a high elastic modulus.

Polymers with high elastic modulus and high stress at break have been the subject of many research activities for a long time.

Nevertheless, there are few polymers commercially manufactured which combine high mechanical properties with the low cost of the used monomers.

The Kevlar fibre produced by Du Pont is an example of a material which can be included in this definition.

Alternatively, fibres with high mechanical properties can be obtained by the reconstruction of superstructures of polymers already existing, which are able to give the desired performances.

In the fibres area, spinning in the solid state, the high speed melt spinning, zone orientation, high pressure crystallization, superorientation, and zone annealing are procedures adopted to obtain completely extended crystalline chains.

In the case of fibres, the ideal situation of a super-structure is when molecules belonging to amorphous regions with even length and even strength at break (tie molecules) cross the crystalline regions without lamelles.

It is known that the deflection and the stress breakage of the fibres propagate through the amorphous regions: this phenomenon causes an extremely low tensile modulus in comparison to the theoretical value (about 1/10-1/100 of the theoretical value).

U.S. Pat. No. 4,917,848 discloses a process for producing high tenacity and high modulus fibres by melt-spinning a polyester resin, wherein the unoriented filaments are subjected to post-polymerization in a heating liquid medium and then to multi-stage drawing. The elastic modulus of the obtained drawn filament is at most 30.6 GPa.

SUMMARY OF THE INVENTION AND DETAILED DESCRIPTION OF THE PREFERRED EMBODIMENTS

It has been now unexpectedly found a method to obtain polyester fibres with very high elastic modulus.

The fibres of the present invention show an elastic modulus equal or higher than 37 GPa and can reach 110 or more GPa.

The stress at break of these fibres is usually between 300 and 600 MPa.

The fibres are obtained, according to known processes by spinning polyester resin mixed in the melt state with polyfunctional compounds capable of increasing the intrinsic viscosity of the polymer by addition reactions in the solid state with the end groups of the polyester resin. The fibres obtained in this way are submitted to an upgrading treatment in the solid state carried out under stretching. The upgrading treatment in the solid state leads to an increase of the intrinsic viscosity of the resin.

The treatment is carried out at temperatures generally comprised between 150° C. and 240° C. from a few minutes to one or more hours.

The fibres are maintained under stress during the heating treatment using stretching ratios from 1:2 to 1:8 referred to the fibre before heating. As started supra the fibres are obtained with conventional spinning processes.

The stretching ratios usually used in this stage are between 1:2 and 1:4.

The preferred polyfunctional compounds are dianhydrides of aromatic tetracarboxylic acids. The dianhydride of the pyromellitic acid is the most preferred compound. The compounds are used in quantities usually between 0.05 and 2% by weight on the resin.

The mixing of the resin with the polyfunctional compound, is carried out by the extrusion of the mixture in single or twin screw extruders. Controrotating non-intermeshing twin screw extruders are the preferred ones. The residence time is usually less than 200 sec. A short residence time avoids excessive resin reactions in the melt state. The temperature in the extruder is generally between 200° and 350° C. The resin added with the polyfunctional compound is pelletized and, the granules are then ready for the spinning.

The polyester resins used in the process of the present invention are the product of the polycondensation reaction of a bicarboxylic aromatic acid, such as terephthalic acid or its derivatives as the dimethyl ester or naphthalene bicarboxylic acid or its derivatives with diols with 2–12 carbon atoms as ethylene glycol 1,4 cyclohexandyol 1,4 - butandyol. The definition also includes copolymers in which some of the units deriving from the terephthalic acid (up ca. 25%) are substituted isophthalic acid units or naphthalene bicarboxylic acid units. Polyethylene terephthalate is the preferred resin. The extrusion of the resin added with the polyfunctional compound and spinning step can be carried out continuously. The upgrading treatment under stretching of filaments may also be performed continuously.

The polyester resin can be mixed with other compatible polymers such as polycarbonates, polycaprolactone or polyamid 6 or 66 up to ca. 20% by weight.

The mechanical properties of the fibres (elastic modulus) can be further improved by addition of small quantities of polymers or compounds (up to about ca. 5% of weight) which have properties of liquid crystals containing reactive groups such as OH and $NH_2$ groups. Monofilaments of the present invention are particularly suitable as reinforcing elements in tires in place of the steel cords. They can be also used for fishing nets for deep sea water.

The following examples are given to illustrate and not to limit the invention.

EXAMPLE 1

30 kg/h of polyethylene terephthalate (PET) with a melting point of 253° C. and intrinsic viscosity, of 0,66 dl/g are continuously, fed from the polycondensation section in the melt state of PET to a controrotating and not intersecting twin screw extruder of mm. 30 in diameter, equipped with a device for outgassing.

880 g/h of a blend at 20% by weight of pyromellitic dianhydride in crystallized powdered of PET (IV=0.64 dl/g) are continuously fed to an extruder using a gravimetric feeder.

The test conditions are the following:

Pyromellitic dianhydride in the melt=0.6% by weight.

Screw speed=415 RPM

Length/Diameter ratio of the screw=24

Average residence time=18–25 sec.

Cylinder temperature=283° C.

Melt temperature=290° C.

A mold with a double hole is used for the extrusion (diameter=7 mm)

A strand pelletizer is used to obtain granules with a cylindrical shape having a diameter of 3 mm and length of 5 mm. The intrinsic viscosity of the granule is 0.65 dl/g.

10 kg/h of these granules are fed, after drying, to a spinning section of a laboratory scale. A single screw extruder having a filter and a metering pump is used for the purpose. The material is extruded through a spinneret having 120 holes of 1 mm. The filaments are gathered on slow and cooled rolls; then, gathered on heated rolls (heated up to the polymer transition temperature) and then drawn with a draw ratio 4.

The obtained filaments are heated under constant weight of 5N. in a nitrogen athmosphere, under the conditions reported in the following table, where the mechanical properties of the filaments are also reported. For comparison, mechanical properties of high modulus carbon, kevlar, glass, nylon and known type PET fibres are listed.

TABLE

| FIBER | UPGRADING TEMP. C.° | TIME h | ELASTIC MODULUS GPa | STRESS AT BREAK MPa | ELONGATION AT BREAK % | DIAMETER mm. |
|---|---|---|---|---|---|---|
| 1 | 230 | 20 | 64 | 330 | 3.5 | 0.22 |
| 2 | 230 | 8 | 61 | 310 | 5 | 0.26 |
| 3 | 230 | 4 | 56 | 520 | 4.4 | 0.21 |
| 4 | 230 | 5 | 100 | 530 | 2.4 | 0.17 |
| 5 | 235 | 4 | 37 | 360 | 3.9 | 0.30 |
| 6 | 220 | 2 | 46 | 560 | 2.5 | 0.36 |
| 7 | 210 | 2 | 108 | 590 | 2.5 | 0.14 |
| 8 | 230 | 10 | 65 | 390 | 1.1 | 0.23 |
| 9 | 215 | 8 | 101 | 320 | 3.1 | 0.28 |
| carbon fiber | | | 300 | 2100 | 1.8 | |
| Kevlar-49 | | | 120 | 2800 | 2.3 | |
| glass fiber | | | 80 | 4000 | 4 | |
| polyethylene fiber | | | 120 | 2600 | 1.5 | |
| nylon fiber | | | 5 | 950 | 4 | |
| PET fiber | | | 10 | 350 | 22 | |

The tensile modulus and the elongation at break have been determined according to ASTM D-638 on samples have length of 40 mm. The diameter of the sample is determined using a stereo microscope. The intrinsic viscosity is determined on a solution of 0.5 g of chips in 100 ml of a mixture at 60/40 by weight of phenol and tetrachloroethane at 2520 according to ASTM D-4603 - 86.

We claim:

1. Filaments consisting essentially of an aromatic polyester resin made of aromatic acid and aliphatic alcohol and a polyfunctional compound of dianhydrides of aromatic tetracarboxylic acids, having a modulus of elasticity higher than 30 G Pa and stress at break higher than 300 MPa.

2. Filaments according to claim 1 wherein the polyfunctional compound is a dianhydride of pyromellitic acid.

* * * * *